US008689464B2

(12) United States Patent
Rodman et al.

(10) Patent No.: US 8,689,464 B2
(45) Date of Patent: Apr. 8, 2014

(54) MAGNETICALLY-SUPPORTED ARTICLE OF FOOTWEAR

(76) Inventors: Jared David Rodman, Newton, MA (US); Joseph Andrew Haber, Newton, MA (US)

( * ) Notice: Subject to any disclaimer, the term of this patent is extended or adjusted under 35 U.S.C. 154(b) by 638 days.

(21) Appl. No.: 12/914,277

(22) Filed: Oct. 28, 2010

(65) Prior Publication Data

US 2012/0102785 A1 May 3, 2012

(51) Int. Cl.
*A43B 13/18* (2006.01)

(52) U.S. Cl.
USPC ..... 36/28; 36/25 R

(58) Field of Classification Search
USPC ..... 36/25 R, 27, 28, 35 R
See application file for complete search history.

(56) References Cited

U.S. PATENT DOCUMENTS

| | | | | |
|---|---|---|---|---|
| 4,067,125 | A * | 1/1978 | Greene, Sr. | 36/35 R |
| 5,502,901 | A * | 4/1996 | Brown | 36/28 |
| 6,405,456 | B1 | 6/2002 | Nichelson | |
| 7,694,440 | B1 * | 4/2010 | Wu | 36/44 |
| 2003/0213146 | A1 * | 11/2003 | Tien et al. | 36/28 |
| 2004/0107602 | A1 * | 6/2004 | Brown | 36/28 |
| 2010/0011616 | A1 | 1/2010 | Chang | |

* cited by examiner

*Primary Examiner* — Marie Patterson
(74) *Attorney, Agent, or Firm* — Wilmer Cutler Pickering Hale and Dorr LLP

(57) ABSTRACT

A magnetically-supported article of footwear that primarily supports a wearer's weight by repulsive magnetic forces from magnets arranged in and around the article's sole. The magnets are arranged between and around the article's insole and outsole and may be attached to pairs of magnetically-conductive plates located down the length of the article's sole. Each plate has two magnets, one with a north pole facing upwards and one with a north pole facing downward. Also disclosed is an independent magnetically-supported sole assembly suitable for attachment to an existing article of footwear's sole so that, when attached, the weight of the wearer of that article is primarily supported by repulsive magnetic forces.

14 Claims, 10 Drawing Sheets

MAGNETICALLY-SUPPORTED ARTICLE OF FOOTWEAR

FIELD OF THE DISCLOSURE

This disclosure relates to an article of footwear where the sole of the footwear is supported by opposing magnetic forces.

BACKGROUND

Many varieties of footwear have been worn by people of all cultures for thousands of years. People use footwear that range in type from athletic shoes, to boots, to sandals, to other specialized types of footwear such as baseball cleats or ballet shoes. People use footwear to protect their feet from the surfaces on which they walk, to reduce the shock to their feet and ankles from physical activity, and to provide support and comfort. People depend on their footwear to support their feet and ankles, even when walking outdoors on rough or uneven surfaces. People use footwear for a large portion of their lives and so want their footwear to be comfortable, well-cushioned, and to support their feet during all of their activities. The bottom of a person's foot comes into contact with, and is supported by, the sole structure of their footwear and so the sole is the part of an article of footwear that must be particularly well-cushioned and supportive.

Prior articles of footwear have had soles which separate a wearer's foot from the surface on which that wearer is present. Many materials and techniques have been used to provide improved cushioning and support for a wearer's foot. Some articles of footwear have magnets in their soles to help support the weight of their wearer, but do so in the context of other cushioning or support systems. Prior footwear has not used magnetic forces as the primary means of support, or to levitate a wearer's foot, in order to avoid shocks and stresses transmitted through contact of a wearer's footwear with the ground.

Some prior art footwear has hollowed heel cavities with a number of springs extending from the top of the cavity to the bottom of the cavity to cushion and support a wearer's heel, with opposing magnets mounted in the cavity to aid the springs in cushioning a wearer's foot. Other prior art footwear use multiple mechanical shock absorbers placed inside of and around the sole with a flexible middle sole having a cavity filled with water or gel and an innersole having multiple cavities filled with compressed air and nitrogen bubbles kept separated by repulsive forces generated by magnets. Yet other prior art footwear has sole structures with two magnets placed inside of a heel cavity, with a foam rubber spacer separating the magnets and filling the remainder of the cavity, such that magnetic forces cushion a user's heel in conjunction with foam rubber and a large heel structure. Such prior art footwear use a substantially solid sole as the primary support for a wearer's foot.

SUMMARY

This disclosure relates to an article of footwear that provides primarily magnetic support or cushioning, and in some embodiments achieves nearly total magnetic support, rather than no magnetic support or merely supplemental magnetic support. The magnets are positioned to support a wearer's entire foot, rather than merely to support cavities within a larger sole structure. The footwear cushions that wearer's foot through the use of repulsive magnetic forces in the sole structure.

In some embodiments, a magnetically-supported article of footwear includes an insole attached to a plurality of upper plates where each upper plate is attached to one or more magnets, a coupling mechanism which substantially restricts movement of the insole with respect to the outsole in substantially all directions except for the direction directly between the insole and the outsole, a plurality of lower plates where each lower plate is attached to one or more magnets which repel the magnets attached to the upper plates, and an outsole that is attached to each of the plurality of lower plates.

In some of these and other embodiments, each magnet attached to one of the upper plates is substantially aligned above, and has an opposing pole from, a magnet attached to a substantially aligned lower plate to provide separation between the plates. In some of these and other embodiments, the plates are spread across an article of footwear's sole such that the magnetic separation of the plates provides the primary support to a wearer's foot.

In some of these and other embodiments, two magnets are attached to each of the upper plates and two magnets are attached to each of the lower plates. In these embodiments, one of the magnets attached to each upper plate has its north magnetic pole facing downwards and is substantially aligned with a magnet attached to a lower plate having its north magnetic pole facing upwards while the other magnet attached to that upper plate has its south magnetic pole facing downwards and is substantially aligned with the other magnet attached to the lower plate having its south magnetic pole facing upwards. Through this configuration, a magnetic circuit is formed among each upper plate and its two attached magnets and a second magnetic circuit is formed among each of the lower plates and its two attached magnets.

In other embodiments, a magnetically-supported sole assembly includes an upper sole suitable for attachment to the sole of an existing article of footwear, a plurality of magnetic support assemblies attached to the bottom of the upper sole and a lower sole where each magnetic support assembly includes an upper plate with one or more magnets attached, a substantially aligned lower plate with opposing magnets attached and substantially aligned with the magnets attached to the upper plate, and one or more joints attaching the plates or soles and allowing vertical movement of the upper plate with respect to the lower plate.

DETAILED DESCRIPTION

This disclosure relates to an article of footwear that is supported by opposing magnetic forces. Some embodiments of the disclosure include an insole, which typically comes into contact with the bottom of a wearer's foot, an outsole, which typically comes into contact with the ground, magnets spread across the insole and outsole supplying repulsive magnetic forces to support the insole and maintain its separation from the outsole, and coupling mechanisms that allow movement between the insole and outsole while preventing the insole from completely separating from the outsole.

Figure 1:
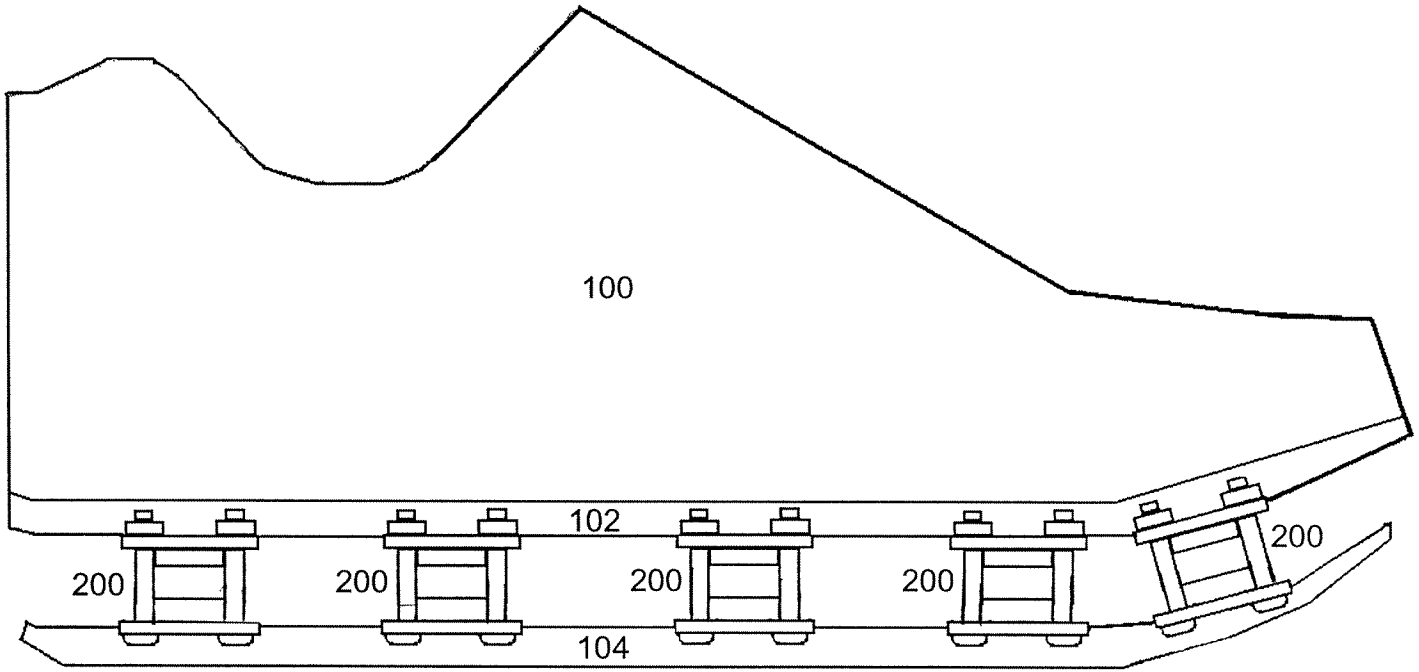
FIG. 1 is a side view of a magnetically-supported shoe, in accordance with some embodiments.
Figure 2:
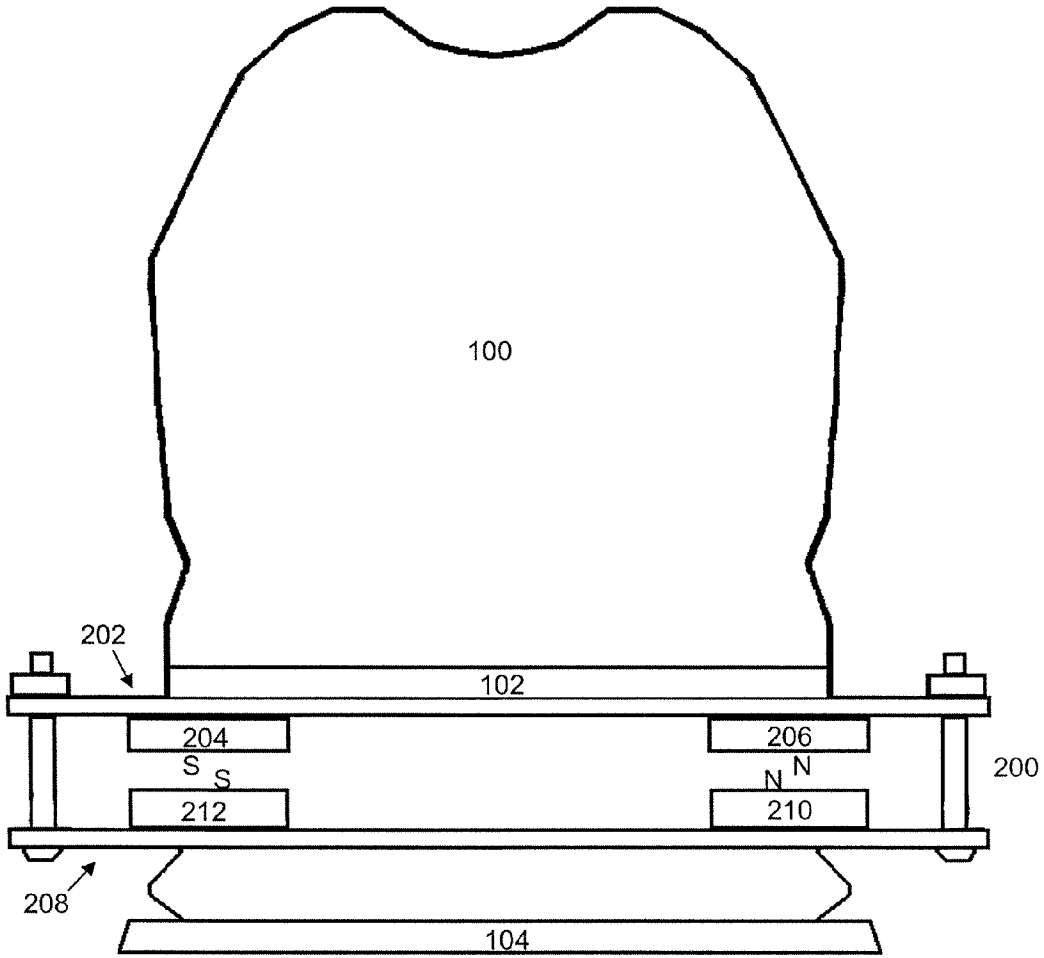
FIG. 2 is a rear view of the shoe of FIG. 1, according to certain embodiments.
Figure 3:
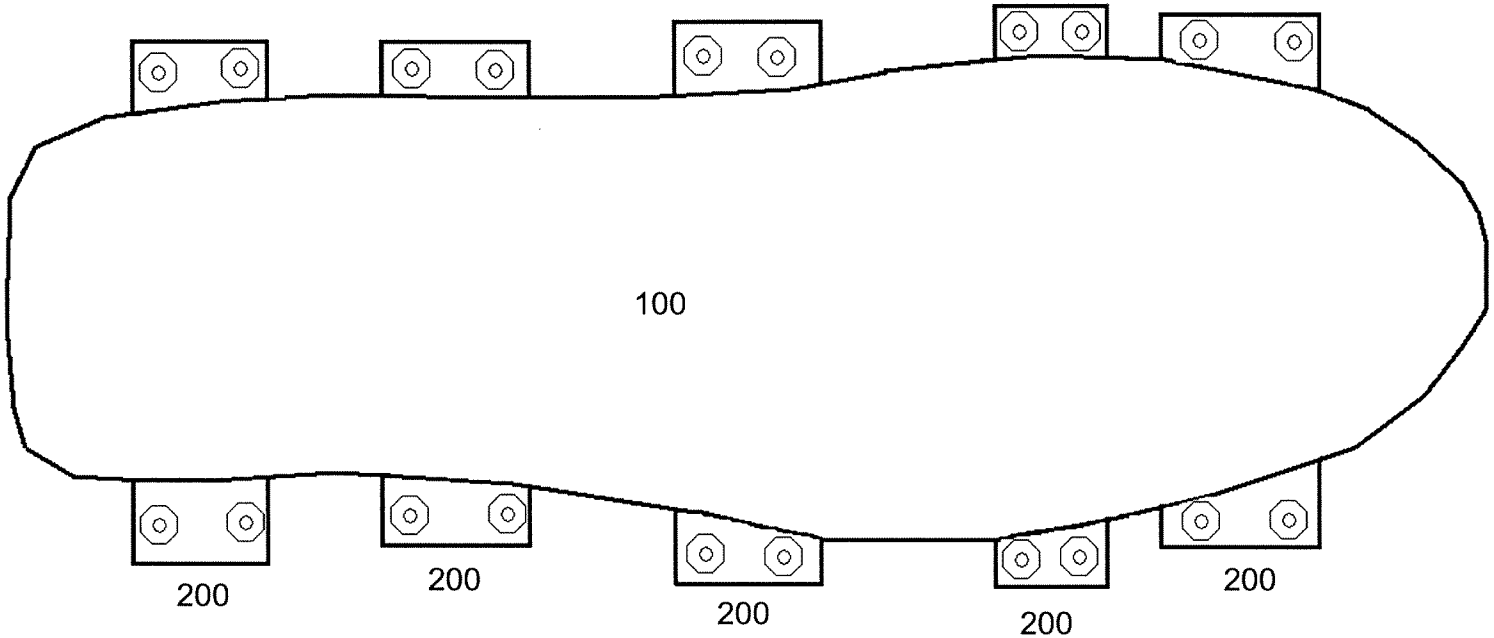
FIG. 3 is a top view of the shoe of FIG. 1, in accordance with some embodiments.
Figure 4:
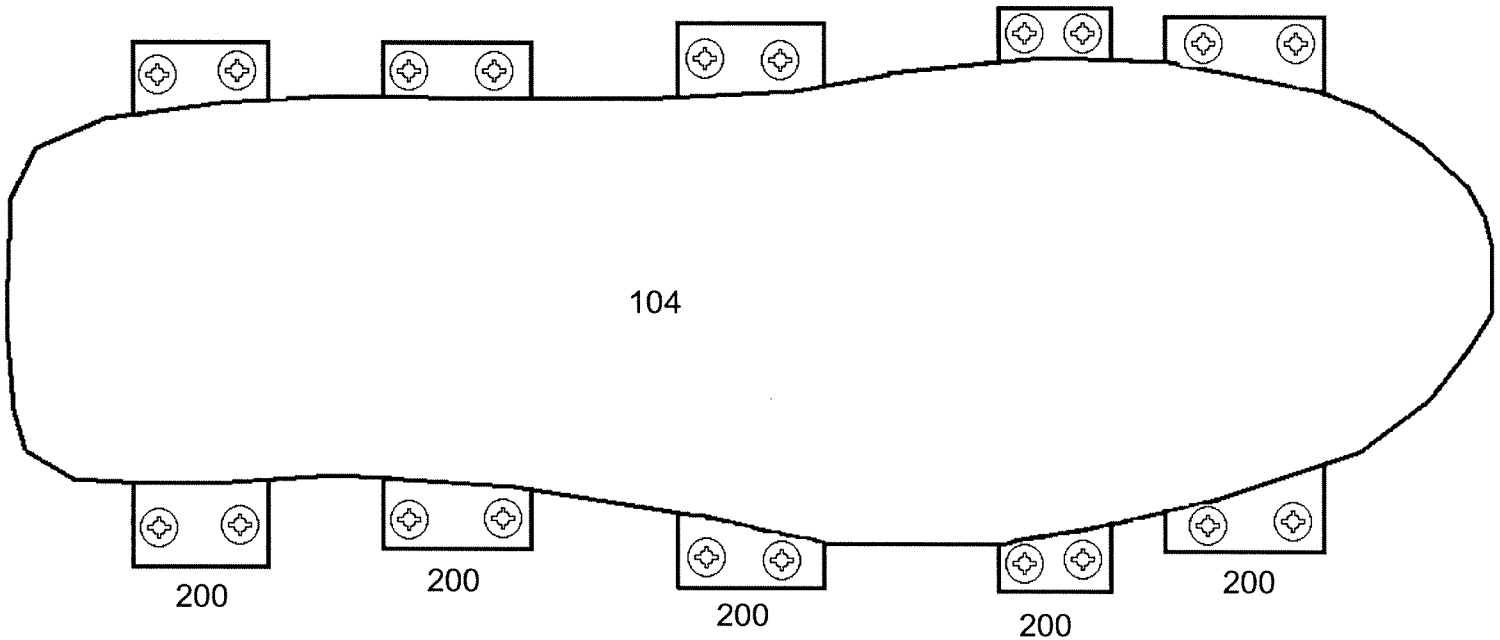
FIG. 4 is a bottom view of the shoe of FIG. 1, according to certain embodiments.
Figure 5:
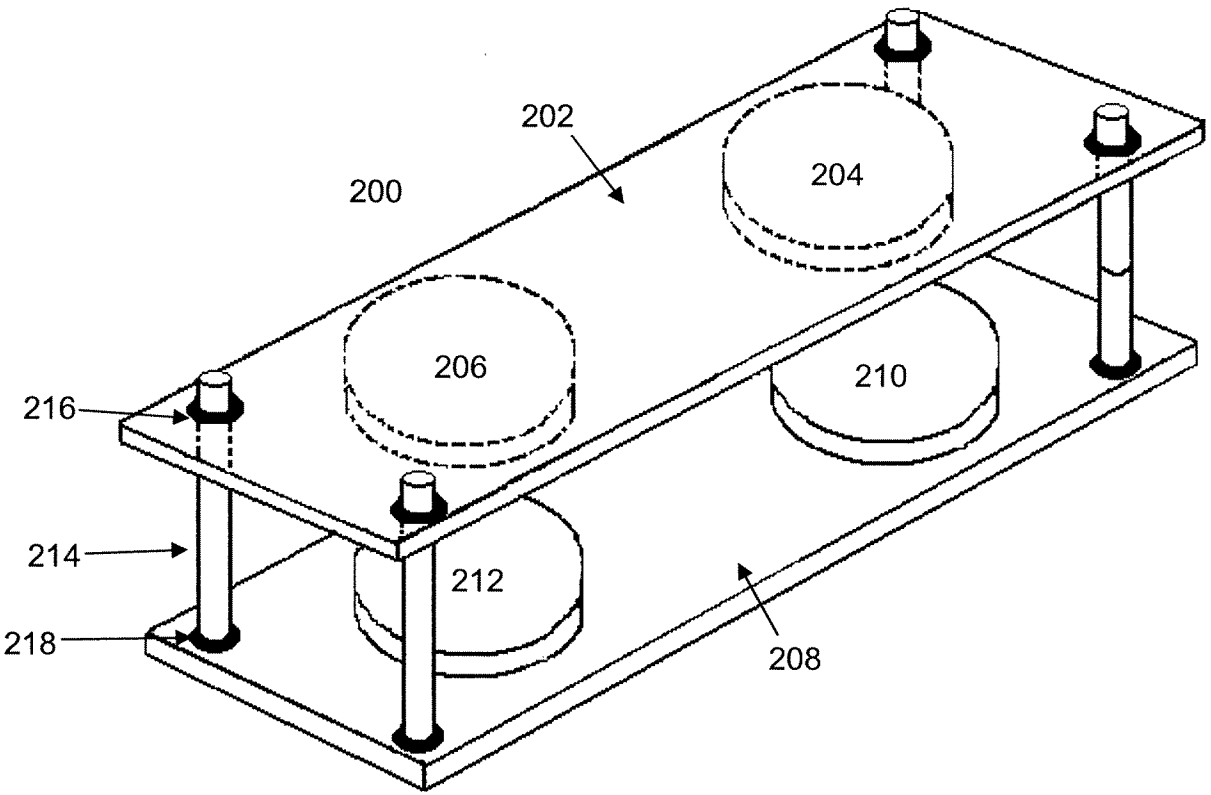
FIG. 5 is a perspective drawing of an independent magnetic support assembly, in accordance with some embodiments.

FIGS. 1-4 show an embodiment that is an athletic shoe 100 supported by five groups of magnetic support assemblies 200 that repel the article's insole 102 from its outsole 104. FIG. 5 illustrates an exemplary magnetic support assembly 200. Other embodiments could be a sandal, a boot, or any other type of footwear, or could be supported by a different number or style of magnetic support assemblies or by different placements of the assemblies. As shown in FIGS. 1 and 2, each magnetic support assembly 200 is attached by the top of its upper plate 202 to the bottom of the insole 102. The top of the outsole 104 is attached to the bottom of the lower plate 208 of each of the magnetic support assemblies 200. As the wearer of the shoe 100 places downward pressure on the insole 102, the magnetic support assemblies 200 magnetically resist movement of the insole 102 towards the outsole 104. As well, in this embodiment, the magnetic support assemblies prevent the insole 102 from shifting laterally with respect to the outsole 104.

As shown in FIG. 5, magnetic support assembly 200 includes an upper plate 202, a lower plate 208, two magnets 204 and 206 attached to the upper plate, two magnets 210 and 212 attached to the lower plate, and four coupling mechanisms which each comprise a bolt 214, an upper nut 216 and a lower nut 218. The first magnet 204 attached to the upper plate 202 is substantially vertically-aligned above the first magnet 210 attached to the lower plate 208 and the second magnet 206 attached to the upper plate 202 is substantially vertically-aligned above the second magnet 212 attached to the lower plate 208. In some embodiments, the magnets 204, 206, 210 and 212 are attached to the upper and lower plates 202 and 208 using steel epoxy. This steel epoxy may be J-B Weld's steel epoxy, which provides cold welding following the combination of a liquid steel/epoxy resin with a hardening material and sufficient time to set.

Each bolt 214, and the attached nuts 216 and 218, secures the upper plate 202 to the lower plate 208 by passing through holes in the lower plate 208 and upper plate 202. The holes have a slightly greater diameter than the bolts 214, but a smaller diameter than the heads of the bolts, thus allowing the bolts 214 to slide vertically through the holes but not to substantially shift laterally. Each of the bolts 214 are threaded to allow the attachment of the upper nut 216 and the lower nut 218. Each of the nuts 216 and 218 has a larger outer diameter than the holes in the upper plate 202 and lower plate 208. Each bolt 214 is first inserted upwards through a hole in the lower plate 208 so that its head is flush against the bottom surface of the lower plate 208. Next the lower nut 218 is screwed onto the bolt 214 so the lower nut 218 is flush against the upper surface of the lower plate 208. This configuration secures the bolt 214 to the lower plate 202 so that the two cannot substantially move relative to one another. The upper plate 202 is then placed so that the bolt's non-headed end runs through a hole in the upper plate 202. Finally, the upper nut 216 is screwed onto the bolt 214. This configuration allows the upper plate 202 to slide down towards the lower plate 208 along the length of the bolts 214, but not up past the upper nuts 216. In some embodiments the holes in the upper plates 202 have a greater diameter than the holes in the lower plates 208, which allows the upper plates 202 to slide more easily along the bolts 214.

In some embodiments, the magnets 204, 206, 210 and 212 are rare-earth neodymium magnets, also called NdFeB magnets. In some embodiments, the magnets are each shaped as a circular disk, although rectangles or other shapes may be used. In some embodiments, each magnet has a diameter between 0.5 and 1.5 inches and a thickness between 0.1 and 0.4 inches. The magnet may have different sizes or may all be the same size. In some embodiments, the upper plate 202 is made of magnetized steel and the first attached magnet 204 has its north magnetic pole facing towards the lower plate 208 while the second attached magnet 206 has its south magnetic pole facing towards the lower plate 208. In this way, a magnetic circuit is formed among the upper plate 202 and its attached magnets 204 and 206, with the effect of creating the circuit's north magnetic pole at the first attached magnet 204 and the circuit's south magnetic pole at the second attached magnet 206, with both poles facing towards the lower plate 208. Similarly, in some embodiments the lower plate 208 is made of magnetized steel and the first attached magnet 210 has its north magnetic pole facing towards the upper plate 202 and the second attached magnet 212 has its south magnetic pole facing towards the upper plate 202. As with the upper plate 202 and its attached magnets 204 and 206, this arrangement forms a magnetic circuit among the lower plate 208 and its attached magnets 210 and 212, with the effect of creating the circuit's north magnetic pole at the first attached magnet 210 and the circuit's south magnetic pole at the second attached magnet 212, with both poles facing towards the upper plate 202. In other embodiments, the plates can be made of different materials. By way of nonlimiting example, the plates can be made of other ferromagnetic materials.

In some embodiments, the magnetic support assembly includes substantially parallel upper and lower steel plates, each plate having a magnet with a north magnetic pole and a magnet with a south magnetic pole facing the other plate, the magnets being arranged such that each magnet faces another magnet with like poles facing each other, providing repulsive magnetic force. By alternating the polarity of the magnets on each steel plate, the demagnetizing effect of like poles facing each other is not a factor in the magnet pairs, and the magnetic fields of the magnets reinforce their magnetic cushioning properties and provide a longer life for the magnets.

Figure 6:
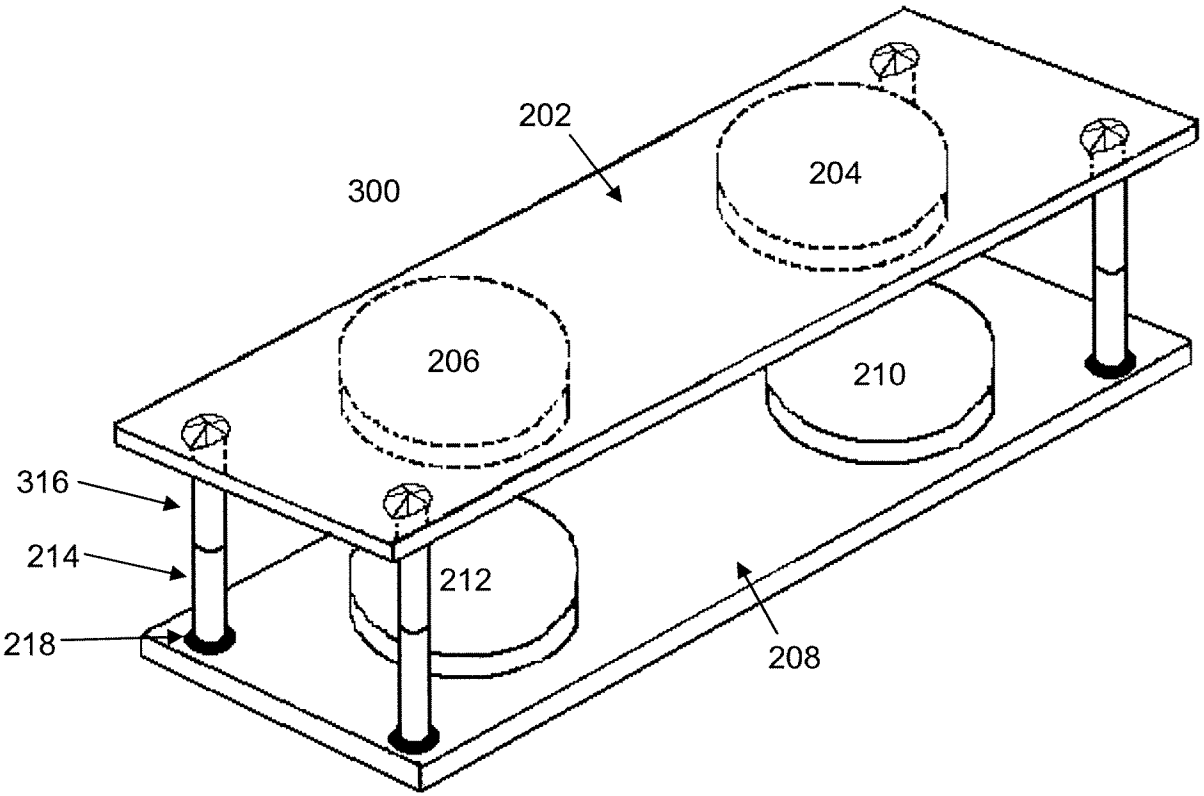
FIG. 6 is a perspective drawing of an independent magnetic support assembly, according to certain embodiments.

As shown in FIG. 6, some embodiments may have magnetic support assemblies 300 coupled by screw posts 316 instead of the upper nuts 216, such that the screw posts 316 are inserted through holes in the upper plate 202 and screwed onto the bolts 214 so that the heads of the screw posts are above the upper plates 202. The screw posts 316 are hollow cylinders with threaded interiors, smooth exteriors, one open end and one end capped with a head larger in diameter than the holes in the upper plate 202 so that the upper plate 202 and lower plate 208 are locked together, but the upper plate 202 can slide closer to the lower plate 208 and away from the heads of the screw posts 316. When the screw posts 316 are screwed onto the bolts 214 through their open end they provide a smooth outer surface so that the upper plate 202 can slide smoothly towards the lower plate 208 with reduced friction from the holes in the upper plate 202 and without contacting the threads of the bolts 214.

While FIGS. 5 and 6 illustrate two possible ways in which the upper and lower plates may be attached, other embodiments may use any other known method of ensuring that the insole 102 does not completely separate from the outsole 104 and that the insole 102 remains substantially vertically-aligned with the outsole 104. For example, other embodiments may use compressible shafts or sleeves of material running between the plates of a magnetic support assembly. Yet other embodiments may use jointed sheets of material attached to the plates of a magnetic support assembly that allow vertical compression but substantially restrict movement in all other directions. Yet other embodiments may couple the insole 102 directly to the outsole 104 without connection to any plates or other magnetic support assembly component using any of the methods described above or any other known methods.

Figure 8:
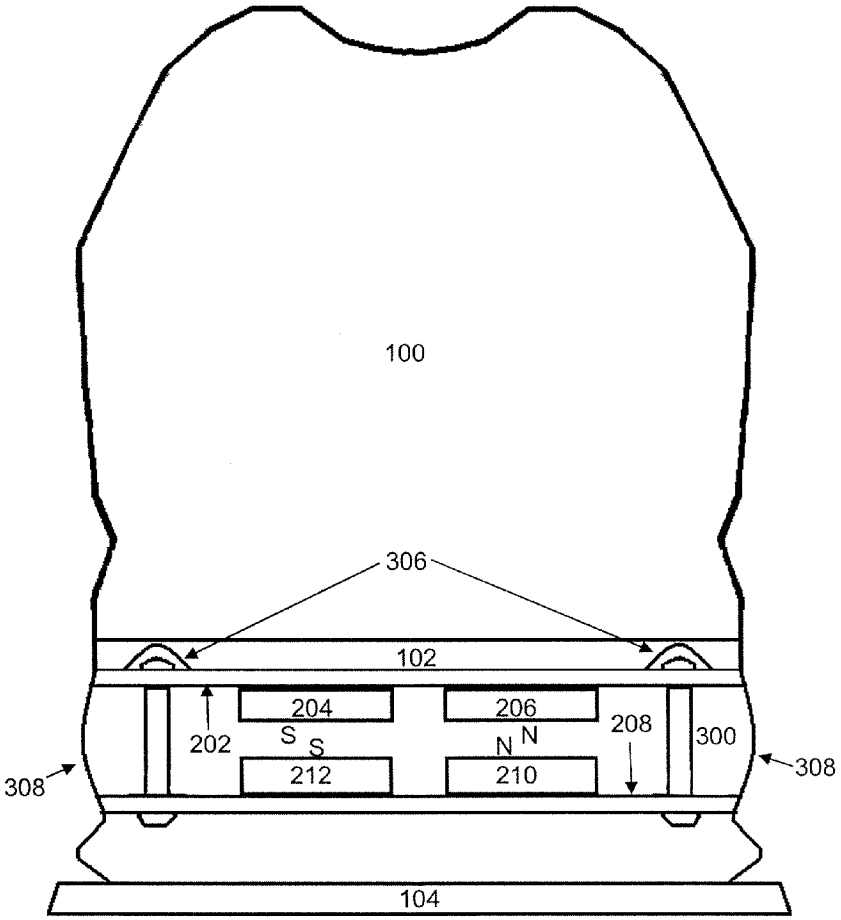
FIG. 8 is a cross-sectional rear view of the shoe of FIG. 7, according to certain embodiments.

As shown in FIG. 8, in some embodiments each of the magnetic support assemblies 300 are the same width as, or narrower than, the portions of the insole 102 and outsole 104 to which they are attached. These embodiments have cavities 306 in the insole 102 that contain the portions of the magnetic support assemblies 300, including the bolts 116, screw posts 316, or any other alternative coupling mechanism or component of such mechanism, that rests or moves relatively above the top surface of the magnetic support assemblies 300. In this way, as the weight of a wearer forces the insole 102 down towards the outsole 104, the portions of the magnetic support assemblies that may slide relatively above the upper plates 202 of those assemblies have space to move inside of the cavities 306 without damaging the insole 102 or injuring the wearer's foot.

Figure 7:
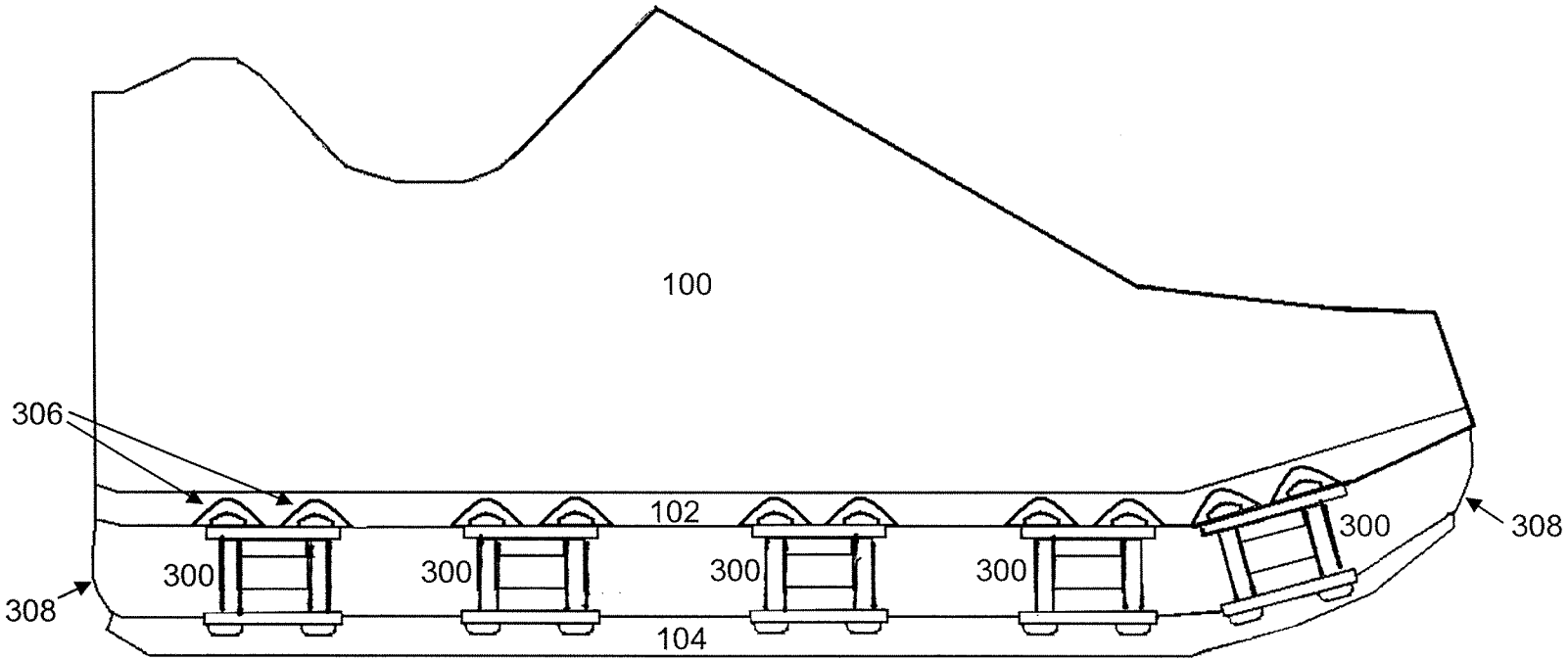
FIG. 7 is a cross-sectional side view of a magnetically-supported shoe, in accordance with some embodiments.

As shown in FIGS. 7 and 8, some embodiments have a covering material 308 that traverses the outside surfaces of the insole 102 and the outsole 104 to protect the magnetic support assemblies from outside contamination or to conceal these components from view. This cover 308 is attached to the outside perimeter of the insole 102 and extends downward to attach to the outside perimeter of the outsole 104 so that the magnetic support assemblies 300, including any plates, magnets or coupling mechanisms, are enveloped within the insole 102, the outsole 104 and the material 308. This cover 308 may be opaque, to conceal the article's magnetic support mechanisms, or partially or totally transparent. This cover 308 may be made of a silicone rubber, or any other material with suitable tensile qualities such that it protects the enveloped components from outside contamination and/or conceals them from view. In some embodiments, cover 308 does not provide substantial support to a wearer's foot, as substantially all the support is provided by magnetic repulsion. In some embodiments, the cover 308 extends only around a portion of the insole 102 and outsole 104, and in some embodiments, different covering materials are used at different portions of the cover.

While FIGS. 1-4 and 7-8 illustrate five magnetic support assemblies 200 or 300, each having an upper plate 202, a lower plate 208, four magnets 204, 206, 210 and 212, and associated coupling mechanisms, other embodiments may use a different number of magnetic support assemblies, and the support assemblies may have different numbers of magnets. Some embodiments may have the plates positioned beneath the portions of the insole 102 where a typical wearer exerts the most downward force when standing, walking, or performing other activities. Even within a given embodiment, the number or configuration of magnets associated with each magnetic support assembly 200 or 300 may differ to reflect the different degree of downward force that a wearer exerts onto the insole 102 of an embodiment from different parts of that wearer's foot. Some embodiments may have recesses in the insole 102 or outsole 104 in which the upper or lower plates are secured. As well, other embodiments may not use magnetic support assemblies, and instead attach the repulsive magnets between or around the insole 102 and outsole 104 using any other known method. Some of these embodiments may create magnetic circuits, if magnetic circuits are to be employed by those embodiments, by conducting the magnetic field between magnets using known methods other than contact with a magnetized steel plate, such as by connection with a magnetically-conducting wire or flexible magnetically-conducting sheet. Other embodiments may use only a single pair of plates and some of these embodiments may use plates which comprise alternating magnetic and non-magnetic portions to allow the formation of multiple magnetic circuits through a single plate.

In some embodiments, in addition to providing cushioning, the magnetically supported article of footwear may also find use for therapeutic purposes. For example, embodiments disclosed herein may aid wearers of those articles of footwear who suffer from arthritis of the knee, ankle, or some other area of the body. Further, such articles of footwear may be used to help strengthen or stabilize certain portions of the wearer's body.

Some embodiments may have an insole 102 and an outsole 104 with different curvatures or flexibility than that depicted in FIGS. 1 and 7. In these embodiments, any components attached in or around the insole or outsole may be similarly angled to match the angle of the insole 102 and outsole 104 as illustrated in FIGS. 1 and 7, and may rotate or swivel in a known manner to support the wearer's foot as the foot alters the curvature, or changes the position relative to the ground, of a flexible insole 102 and outsole 104.

Some embodiments of the disclosed article of footwear provide substantially no upward support to a wearer's foot from any cushioning mechanisms other than repulsive magnetic forces. In these embodiments, substantially no support is provided by any coupling mechanism between the upper and lower plates of the magnetic support assemblies 200 or 300, such as the bolts 116, if present, or directly between the insole 102 and outsole 104, such as by the cover 308, if present.

Figure 9:
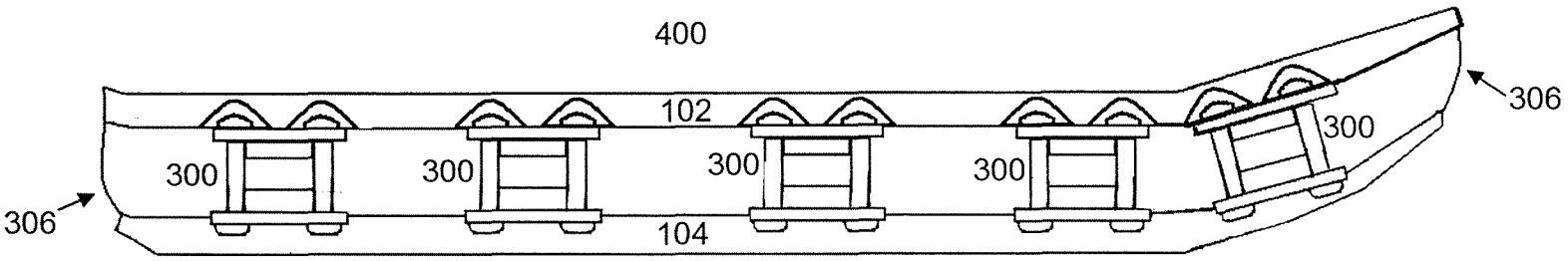
FIG. 9 is a cross-sectional side view of a magnetically-supported sole assembly, in accordance with some embodiments.
Figure 10:
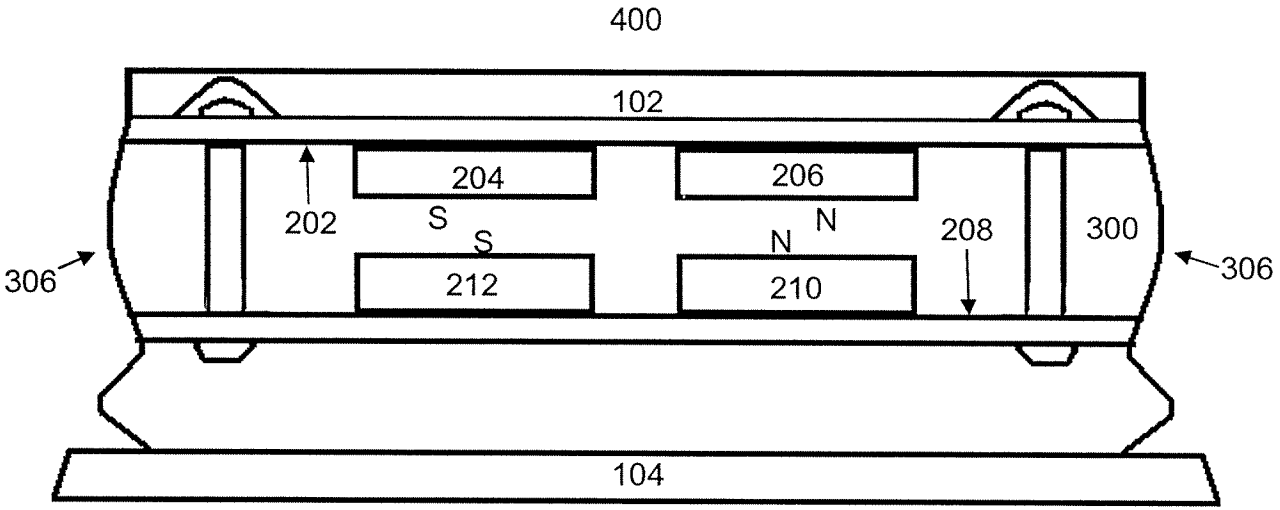
FIG. 10. is a cross-sectional rear view of the sole assembly of FIG. 9, according to certain embodiments.

As shown in FIGS. 9 and 10, other embodiments comprise isolated magnetically-supported sole assemblies 400 suitable for attachment to an insole or the outsole of an existing article of footwear, or to replace a worn-out sole assembly. These embodiments are designed to resist compression of their insole 102 towards their outsole 104 in substantially the same manner as the sole structures of the embodiments illustrated in FIG. 1-4 or 7-8, and as described above. These embodiments, when attached to an article of footwear, provide primarily magnetic support to the wearer of that article. As such, these embodiments may be sold as a kit for modification of an existing article of footwear. These embodiments may be attached to an existing article of footwear's sole by glue, straps, or any other known method.

Although the present invention has been described and illustrated in the foregoing exemplary embodiments, it is understood that the present disclosure has been made only by way of example, and that numerous changes in the details of implementation of the invention may be made without departing from the spirit and scope of the invention, which is limited only by the claims that follow. Other embodiments are within the following claims. For example, some embodiments may be magnetically-supported sandals, have a gel attached between the insole and outsole containing the magnets, use pneumatic rods as coupling mechanisms attaching the insole to the outsole, or use electromagnets to provide repulsive magnetic forces.

What is claimed is:

1. A magnetically-supported article of footwear, comprising:

an insole having a first surface and a second surface;

a first plurality of upper plates, wherein each one of the first plurality of upper plates has a first surface and a second surface, is attached to the insole and has a magnet attached;

a coupling mechanism, which substantially restricts movement of the insole with respect to the outsole in substantially all directions except for a direction directly between the insole and the outsole;

a second plurality of lower plates, wherein each one of the second plurality of lower plates has a first surface and a second surface, has a magnet attached, and is aligned substantially with a plate from the first plurality of upper plates; and an outsole having a first surface and a second surface, attached to each one of the second plurality of lower plates; wherein each magnet attached to one of the first plurality of upper plates is aligned with a magnet attached to the substantially aligned plate of the second plurality of lower plates to provide separation between the substantially aligned upper and lower plates;

the first and second plurality of plates are positioned across the sole of the article; and each of the first plurality of upper plates has a first magnet and a second magnet attached and each substantially aligned plate of the second plurality of lower plates has opposing magnets attached, such that each magnet attached to an upper plate is substantially aligned with a magnet attached to a lower plate.

2. The article of 1, wherein the first plurality of upper plates and the second plurality of lower plates both comprise magnetized steel.

3. The article of claim 1, wherein the first of the magnets attached to each of the first plurality of upper plates has a north magnetic pole facing a north magnetic pole of the aligned magnet attached to the substantially aligned plate of the second plurality of lower plates, and the second of the magnets attached to each of the first plurality of upper plates has its south magnetic pole facing a south magnetic pole of the aligned magnet attached to the substantially aligned plate of the second plurality of lower plates.

4. The article of claim 1, wherein each of the first plurality of upper plates is the same width as, or narrower than, the portion of the insole to which that upper plate is attached and each of the second plurality of lower plates is the same width as, or narrower than, the portion of the outsole to which that lower plate is attached.

5. The article of claim 4, further comprising a cover attached to the insole and extending to and attaching to the outsole surrounding the first plurality of upper plates, the second plurality of lower plates, and the coupling mechanism.

6. The article of claim 1, wherein the magnets are attached to the first plurality of upper plates and the second plurality of lower plates using steel epoxy.

7. The article of claim 1, wherein each magnet attached to either one of the first plurality of upper plates or one of the second plurality of lower plates is a rare-earth neodymium magnet.

8. The article of claim 1, wherein each magnet is shaped as a circular disk having diameter between 0.5 and 1.5 inches and a thickness between 0.1 and 0.4 inches.

9. The article of claim 1, wherein the coupling mechanism includes a plurality of bolt assemblies, wherein one of the plurality of bolt assemblies extends between each of the plurality of upper plates and the substantially aligned plate of the second plurality of lower plates, wherein each bolt assembly includes a bolt having a head flush against the second surface of the substantially aligned plate of the second plurality of lower plates, a nut screwed onto the bolt and flush against the first surface of that lower plate and a screw post extending through a hole in the top of one of the first plurality of upper plates and screwed onto each bolt so that a head of the screw post is flush against the first surface of the upper plate.

10. A magnetically-supported article of footwear, comprising:

an insole;

an outsole;

and a plurality of magnetic support assemblies, each magnetic support assembly having a top side attached to the insole and a bottom side attached to the outsole; wherein each magnetic support assembly includes an upper plate with one or more magnets attached, a substantially aligned lower plate with one or more opposing magnets attached, and one or more joints attaching the plates and allowing vertical movement of the upper plate with respect to the lower plate;

each magnet attached to an upper plate of one of the plurality of magnetic support assemblies is aligned with a magnet attached to the lower plate of the magnetic support assembly to provide separation between the upper and lower plates;

the support assemblies are positioned across the sole of the article; and the upper plates and lower plates of the plurality of magnetic support assemblies both comprise magnetized steel.

11. The article of claim 10, wherein the first of the magnets attached to each of the upper plates of each of the plurality of magnetic support assemblies has a north magnetic pole facing a north magnetic pole of the aligned magnet attached to the lower plate of that same magnetic support assembly, and the second of the magnets attached to the upper plate of that same magnetic support assembly has its south magnetic pole facing a south magnetic pole of the aligned magnet attached to the lower plate of that same magnetic support assembly.

12. The article of claim 10, wherein a width of each of the plurality of magnetic support assemblies is less than or substantially equal to a width of the insole and outsole where the magnetic support assembly is attached.

13. A magnetically-supported sole assembly, comprising:

an upper sole suitable for attachment to an article of footwear;

a lower sole; and a plurality of magnetic support assemblies, each having a top side attached to the upper sole and a bottom side attached to the lower sole; wherein each magnetic support assembly includes an upper plate with one or more magnets attached and a substantially aligned lower plate with opposing magnets attached and substantially aligned with the magnets attached to the upper plate;

the support assemblies are positioned across the sole of the article; and the upper plate and lower plate of each of the plurality of magnetic support assemblies comprise magnetized steel and each upper plate and lower plate of each magnetic support assembly has a first and a second magnet attached.

14. The assembly of claim 13, wherein the first of the magnets attached to each of the upper plates of each of the plurality of magnetic support assemblies has a north magnetic pole facing a north magnetic pole of the aligned magnet attached to the lower plate of that same magnetic support assembly, and the second of the magnets attached to the upper plate of that same magnetic support assembly has its south magnetic pole facing a south magnetic pole of the aligned magnet attached to the lower plate of that same magnetic support assembly.

* * * * *